United States Patent [19]

Fujiu et al.

[11] 4,231,303

[45] Nov. 4, 1980

[54] METHOD FOR INCINERATION OF ORGANIC CHLORINE COMPOUND AND INCINERATOR USED THEREFOR

[75] Inventors: Masayoshi Fujiu, Fujisawa; Tetsuo Hida, Yokohama, both of Japan

[73] Assignee: Showa Denki K.K., Tokyo, Japan

[21] Appl. No.: 956,364

[22] Filed: Oct. 31, 1978

[51] Int. Cl.[3] ..... F23G 5/00

[52] U.S. Cl. ..... 110/245; 110/346

[58] Field of Search ..... 110/245, 346, 235; 122/4 D; 431/7, 170

[56] References Cited

U.S. PATENT DOCUMENTS 3,907,674 9/1975 Roberts et al. ..... 110/245 X 3,994,244 11/1976 Pledger et al. ..... 110/245

*Primary Examiner*—Edward G. Favors

*Attorney, Agent, or Firm*—Oblon, Fisher, Spivak, McClelland & Maier

[57] ABSTRACT

Incineration of an organic chlorine compound is effected by mixing the compound with water or a proper aqueous solution, fluidizing the resultant aqueous mixture and subjecting the fluidized mixture to combustion. For this incineration is used an incinerator which is provided with at least one inlet for admitting the organic chlorine compound and water or the aqueous solution and is adapted to fluidize the mixture of the organic chlorine compound with water or the aqueous solution.

10 Claims, 3 Drawing Figures

METHOD FOR INCINERATION OF ORGANIC CHLORINE COMPOUND AND INCINERATOR USED THEREFOR

BACKGROUND OF THE INVENTION

1. Field of the Invention

This invention relates to a method for enabling organic chlorine compounds produced in various chemical reactions such as the polymerization of high molecular compounds to be incinerated so that the waste gas released from the incinerator will contain a very small amount of chlorine gas.

2. Description of the Prior Art

An organic chlorine compound, on combustion, produces a combustion gas which contains hydrochloric acid gas and chlorine gas. Although the chlorine gas content of such a combustion gas is variable with the particular kind of organic chlorine compound and the conditions of combustion involved, it is generally on the order of at least hundreds of ppm. In an extreme case, it may reach 30,000 ppm.

Since the chlorine gas is a deadly poison, the chlorine gas concentration in an exhaust gas released into the ambient air is controlled most rigidly. Any person incinerating an organic chlorine compound, therefore, is required to decrease the chlorine gas concentration in the exhaust gas from the incinerator to the fullest possible extent.

A particularly effective method for this purpose has been disclosed by Japanese Patent Laid-open Publication No. SHO 49-17371. This method relates to combustion of an organic chlorine compound in the form of a solution.

Generally, combustion of an organic chlorine compound in the form of a solution results in formation of carbon monoxide, carbon dioxide, hydrogen chloride, nitrogen, oxygen, chlorine and steam. In this case, the occurrence of chlorine gas and hydrochloric acid gas is involved in an equilibrated reaction represented by the following formula:

$$4HCl + O_2 \rightleftharpoons 2Cl_2 + 2H_2O$$

The equilibrium constant ($K_1$) of this reaction, therefore, is expressed as follows:

$$K_1 = \frac{[Cl_2]^2\,[H_2O]^2}{[HCl]^4\,[O_2]}$$

Where T stands for the temperature, therefore, $K_1$ and T have a fixed relation such that $K_1$ decreases with the increasing value of T.

The foregoing explanation clearly indicates that the following measures should be taken to lower the amount of chlorine gas formed in the reaction indicated above.

(1) A measure to lower the temperature of combustion.

(2) A measure to increase the partial pressure of water.

(3) A measure to decrease the partial pressure of oxygen.

The invention disclosed by the patent laid-open publication cited above relates to a method which comprises mixing the solution of a given organic chlorine compound with water or an aqueous solution, subjecting the mixture to combustion and, at the same time, directly spraying water or the aqueous solution onto the flame of combustion. The specification of the cited publication implies that an ordinary combustion furnace is used in working the invention so disclosed. According to what is described in the specification, a minor part of the amount of water required for the method is first used for mixing with the organic chlorine compound and the remaining major amount of water is sprayed onto the flame of combustion. By the method disclosed in the specification, however, it is difficult for the gas (namely, the flame of combustion) under treatment to be sufficiently mixed with water. Thus, the degree to which the chlorine concentration in the exhaust gas under treatment can be decreased by this method is limited.

Also there is a high possibility that the organic chlorine compound under treatment may contain a substance such as an alkali which, upon combustion, produces a low-melting compound. Since such a low-melting compound escapes being removed by the ordinary method of combustion such as is disclosed by the aforementioned patent laid-open publication, it brings about a disadvantage that the spray nozzle is clogged to the extent of lowering the efficiency of combustion and the compound adheres, either in its unaltered form or in the form of a salt, to the interior walls of the furnace and duct.

SUMMARY OF THE INVENTION

An object of the present invention is to provide a method for enabling a given organic chlorine compound, without reference to its type, to be incinerated so that the chlorine gas content of the exhaust gas of combustion is minimized.

Another object of this invention is to provide a method for enabling the incineration of the organic chlorine compound to be carried out smoothly even when there is produced a low-melting compound during the combustion.

A further object of this invention is to provide an incinerator capable of causing smooth combustion of a given organic chlorine compound of any kind, with the chlorine concentration in the exhaust gas of combustion minimized, and enabling the combustion to proceed without being adversely affected by possible occurrence of a low-melting compound during the combustion.

To accomplish the objects described above according to the present invention, there is provided a method for incineration of an organic chlorine compound, which comprises forming a fluidized layer of particles of an inert medium, incorporating the organic chlorine compound and water or an aqueous solution separately of or together with each other into the fluidized layer and allowing the resultant mixture to be subjected to combustion. When the particles of the inert medium undergo combustion in conjunction with water or the aqueous solution, part of the particles are crushed by thermal shocks and discharged. When the combustion of the organic chlorine compound happens to byproduce a low-melting compound, the low-melting compound is caused to adhere to the finely crushed particles of inert medium and is consequently carried away as entrained by the crushed particles being so discharged. If, the temperature of combustion is high or the chlorine gas concentration in the exhaust gas of combustion proves to be higher than is tolerable, then the present invention embraces another method which further comprises adding water to the exhaust gas of combustion so as to lower the temperature of combustion and decrease the chlorine gas concentration in the exhaust gas.

The incinerator to be used for working the present invention is a fluidized-solids combustion furnace comprising a hollow column, a perforated dispersion plate disposed at the lower part of the aforementioned hollow column and adapted to form a fluidized bed and a burner for elevating the temperature of the furnace. In the portion of the wall of the hollow column which corresponds to the level at which the fluidized bed is to be formed, the furnace is provided with at least one inlet for admitting the organic chlorine compounds in the form of liquid or slurry and water or the aqueous solution. In the portion of the wall of the hollow column above the level for the formation of the fluidized bed, there is provided an inlet for admitting the solid organic compound. In the upper portion of the hollow column, the furnace is provided with an outlet for releasing the exhaust gas of combustion into the ambience. When necessary, the furnace is also provided in the ceiling of the hollow column with an inlet for admitting water.

The inert medium whose particles are used for the formation of a fluidized bed are required to contain $SiO_2$ and $Al_2O_3$ in a combined concentration of at least 95% by weight and $Na_2O$ and $K_2O$ in a combined concentration of not more than 1.0% by weight. The at least one inlet for admitting the organic chlorine compound in the form of slurry or liquid and water is of a double-wall construction, comprising an inner tube for passing the substance being admitted and an outer tube disposed concentrically around the inner tube. The space enclosed between the inner and outer tubes is used as the passage for air.

The other characteristics and advantages of the present invention will become apparent from a further description to be given herein below with reference to the accompanying drawing.

DETAILED DESCRIPTION OF THE INVENTION

Now, the present invention will be specifically described with reference to FIG. 1.

Figure 1:
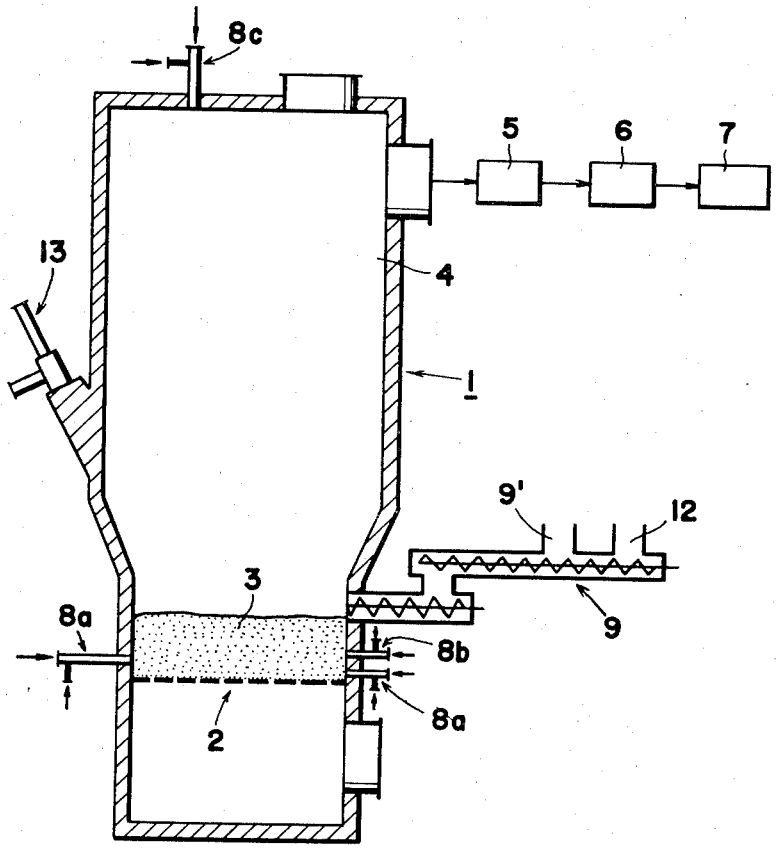
FIG. 1 represents a typical example of the device for working the method of the present invention.

FIG. 1 represents one typical device to be used for working the method of the present invention.

In the device, 1 denotes a fluidized-solids combustion furnace, 2 a perforated dispersion plate adapted to support thereon particles of an inert medium such as silica sand and permit upward passage therethrough of a gas, usually air, and 3 a fluidized bed formed of the particles of the inert medium by virtue of the upward flow of the gas.

Denoted by 4 is a hollow column portion of the device, to which are successively connected an ash recovery unit 5, a hydrochloric acid recovery unit 6 and a suction source 7 (such as, for example, an exhaust blower).

Nozzles 8*a* are inlets through which the organic chlorine compound is admitted into the combustion furnace when the compound is in the form of liquid or slurry. As illustrated, they are disposed at a height such that they will directly open into the furnace interior exactly where the particles of the inert medium are caused to form a fluidized bed above the perforated plate 2.

A nozzle 8*b* is an inlet for admitting water or the aqueous solution into the fluidized bed. Similarly to the nozzles 8*a*, this nozzle 8*b* opens directly into the zone for the formation of the fluidized bed. A nozzle 8*c* disposed at the top of the hollow column serves the purpose of spraying water onto the combustion gas, and this nozzle 8*c* is optionally incorporated in the furnace. By 9 is denoted an element which is used for admitting the organic chlorine compound into the furnace interior where this compound happens to be in a solid state. For example, a screw feeder may be advantageously used as the element. In this case, the element is required to open into the furnace interior at a level higher than the upper boundary of the fluidized bed.

Figure 2:
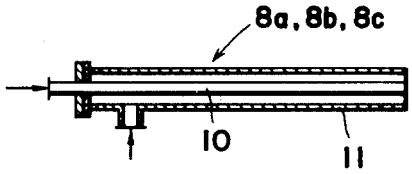
FIG. 2 is a schematic diagram illustrating the construction of an inlet for admitting the organic chlorine compounds in the form of liquid or slurry and water.

Each of the nozzles mentioned above is desired to have a double-wall construction which, as illustrated in FIG. 2, provides an inner passage 10 for the conveyance of the organic chlorine compound, water or aqueous solution and an outer passage 11 formed on the outside of the inner passage and used for the conveyance of a gas, usually air. The inner passage 10 and the outer passage 11 of each nozzle terminate in one plane.

The number of nozzles of each function is not specifically limited. The nozzles may be radially disposed on the wall of the hollow column either in one level or a plurality of levels.

It is more advantageous to have nozzles for the admission of the organic chlorine compound and those for the admission of water or the aqueous solution installed separately of each other than otherwise.

If the organic chlorine compound and water or the aqueous solution are mixed in advance and the resultant mixture is subjected to the fluidized-solids combustion, the contact between the combustion gas and water cannot sufficiently be obtained and the effect of crushing of the fluidized particles by thermal shock is degraded.

Although water is normally added through the nozzle to the fluidized bed, it may be replaced with an aqueous solution. As such aqueous solutions, there are generally used waste waters containing BOD components, oil-containing aqueous solutions having high water contents and other similar waste waters, provided they do not produce noxious gases.

In a typical arrangement, a total of nine nozzles 8*a* are disposed in three horizontal rows in such a manner that the three nozzles in any one row are staggered from those in either of the remaining two rows, with six of these nozzles used for admitting a liquid organic chlorine compound the remaining three nozzles for admitting a slurry-like organic chlorine compound and two nozzles 8*b* for admitting water or an aqueous solution are disposed in a symmetrical relationship.

Figure 3:
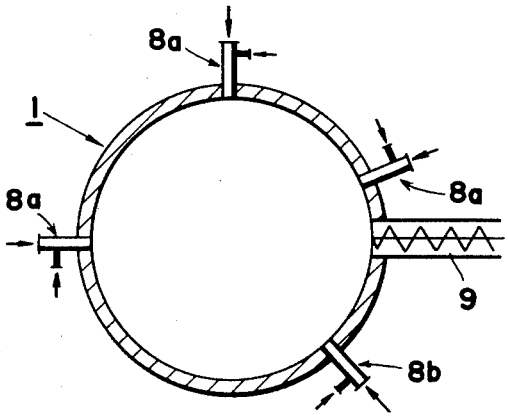
FIG. 3 is a plan view illustrating a typical arrangement of inlets each for admitting the organic chlorine compound in the form of liquid or slurry, an inlet for admitting water and an inlet for admitting a solid organic chlorine compound.

FIG. 3 is a plan view illustrating another typical arrangement of nozzles and an element adapted to admit introduction of a solid feed. In the diagram, the nozzles 8*a* and the nozzles 8*b* are disposed in one same plane.

Now, the particles of an inert medium to be used for the formation of a fluidized bed will be described. Frequently, the organic chlorine compound contains substances such as sodium and potassium which, on combustion, give rise to low-melting compounds. The present invention accomplishes incineration of the organic chlorine compound by means of fluidized-solids combustion. This invention is characterized by using, as the substance for forming the fluidized bed, an inert medium containing $SiO_2$ and $Al_2O_3$ in a combined concentration of not less than 95% by weight and $Na_2O$ and $K_2O$ in a combined concentration of not more than 1.0% by weight.

If the inert medium contains $SiO_2$ and $Al_2O_3$ in a combined concentration not reaching 95% by weight, it means that the medium particles for the fluidization contains impurities such as Na, K, Mg, Ca and Fe in amounts more than are tolerable. In this case, these impurities combine with $SiO_2$ and $Al_2O_3$ to produce low-melting compounds and bring about adverse effects such as obstruction of fluidization and adhesion of fluidized particles to the furnace wall.

If the medium contains $Na_2O$ and $K_2O$ in a combined concentration of more than 1.0% by weight, the impurities present in the medium, particularly Na and K, readily produce low-melting compounds. The portion of $Na_2O$ and $K_2O$ in excess of 1%, in combination with the Na component contained in the chlorine compound, takes part in the formation of such low-melting compounds.

Now, the method for the operation of the incinerator of the present invention will be described.

The fluidized bed 3 is formed by first placing particles of the inert medium on the perforated dispersion plate 2 and then allowing a forced flow of a gas, usually air, to pass upwardly through the bores in the plate 2. When the given organic chlorine compound is in the form of liquid or slurry, it is sprayed in conjunction with a gas, usually air, through the nozzles 8*a* into the fluidized bed. When the organic chlorine compound is in a solid form, then it is pulverized in advance into particles of a suitable diameter, such as 50 mm in maximum diameter and introduced into the fluidized bed through a feed inlet 9′ by means of a screw feeder or some other suitable conveying means. Liquid, slurry-like and solid organic chlorine compounds can be fed to the fluidizing bed either singly or in a combined form. At the same time, from 0.8 to 1.5 parts by weight, based on 1 part of the organic chlorine compound under treatment, of water or the aqueous solution is sprayed through the nozzles 8*b* into the fluidized bed in conjunction with a gas, usually air. If the amount of water or the aqueous solution thus added is less than 0.8 part, the chlorine gas concentration in the exhaust gas of combustion increases. If it exceeds 1.5 parts, then the temperature of the fluidized bed is lowered so much as to upset the heat balance.

Denoted by 13 is a burner which is used for elevating the temperature of the furnace. When this elevation of temperature is completed, the heat from the combustion of the organic chlorine compound serves to maintain the fluidized bed at a desired temperature. Consequently, the organic chlorine compound undergoes spontaneous combustion. By virtue of the particles in the fluidized state, the chlorine gas liberated during the combustion is brought into ample contact with the water which has been sprayed into the fluidized bed, with the result that the chlorine gas is converted into HCl and the temperature of the exhaust gas of combustion within the furnace is maintained at a contact level (750° to 1050° C.) owing to the cooling with water and the vaporization of water.

Part of the particles of the inert medium are crushed by the thermal shock and the crushed particles are allowed to ascend from the fluidized bed and finally escape out of the furnace interior into the ambient air. If the organic chlorine compound under treatment happens to contain sodium and/or potassium, for example, and these compounds give rise to low-melting compounds, such low-melting compounds adhere to the crushed particles which are on their way to the ambient air. As the incineration proceeds, there naturally occur ashes. The incinerator is provided outside the furnace proper thereof with an ash recovery unit (such as, for example, a cyclone collector). The escaping crushed particles which entrain the aforementioned low-melting compounds are recovered together with the ash in this ash recovery unit. As the supply of particles in the fluidized bed decreases in consequence of the flight of such crushed particles, it is replenished by feeding additional particles through a feed inlet 12 of the aforementioned solid feed unit 9.

When the introduction of the liquid or slurry-like organic chlorine compound and that of water respectively to the fluidized bed are effected by use of nozzles of a construction illustrated in FIG. 2, the substances injected through their inner passages are thermally insulated by the currents of a gas, usually air, being injected simultaneously through the outer passages and, consequently, are allowed to advance straight toward the fluidized bed in conjunction with the gas without ever clogging the nozzles owing to polymerization or carbonization of the chlorine compound possibly caused otherwise by heat. Thus, these substances are uniformly distributed throughout the entire fluidized bed and the fluidized-solids combustion is permitted to proceed smoothly. This means that the combustion proceeds under the conditions that minimize the chlorine gas concentration in the equilibrated reaction of the formula touched upon previously.

The combustion temperature is maintained in the range of from 750° to 1050° C. If the temperature of the incinerator rises above the upper limit or the chlorine gas concentration in the exhaust gas of combustion increases beyond the tolerable limit as when the organic chlorine compound subjected to the combustion happens to be a highly volatile liquid or water-rich slurry, water may be sprayed through the top of the furnace into the exhaust gas of combustion so that the temperature will be lowered because of the latent heat due to the vaporization of water and the chlorine gas is converted into hydrochloric acid.

Ash and hydrochloric acid in the exhaust gas are recovered by the ash recovery unit and the hydrochloric acid (gas) recovery unit respectively. For the purpose of the discharge of this gas, the incinerator of this invention is usually provided further with a suction source such as an exhaust blower subsequently to the hydrochloric acid (gas) recovery unit.

Now, the present invention will be described more specifically with reference to working examples hereinafter. Example 1:

As the fluidized-solids combustion incinerator, there was used a furnace of the construction illustrated in FIG. 1. This furnace was 1900 mm in inside diameter and 900 mm in height and was provided with a perforated dispersion plate at a height of 1200 mm from the furnace bottom and with two nozzles for admission of water, one in the side wall of fluidized bed section and one in the furnace top, three nozzles for admission of the liquid organic chlorine compound and one nozzle for admission of the slurry-like organic chlorine compound.

The inert medium whose particles were used for the formation of fluidized bed had a particle diameter of from 0.3 to 0.7 mm and had a composition as follows: 95.54% of $SiO_2$, 2.45% of $Al_2O_3$, 0.25% of $Fe_2O_3$, 0.10% of FeO, 0.15% of MgO, 1.3% of ignition loss and 0.2% of other components (excluding $TiO_2$, CaO and $Na_2O$).

Four tons of the medium was used. The thickness of the fluidized bed was 1,000 mm.

The organic chlorine compound given for treatment was composed of 50% of $H_2O$ and the balance to make up 100% of components (including 45% by weight of C, 10% by weight of H and 40% by weight of Cl determined on dry basis by elementary analysis). This compound was subjected to the combustion continuously for 30 hours. The combustion conditions and the results of combustion were determined at intervals of 10 hours. They were as shown below. Of the data, the decrease ratio of sand was determined per day, the ash recovery ratio per hour and the amount of Na after the first 20 hours of the operation.

| | I | II | III |
|---|---|---|---|
| Amount of compound treated (kg/hr) | 200 | 190 | 190 |
| Furnace floor temperature (°C.) | 900 | 900 | 900 |
| Furnace top temperature (°C.) | 880 | 875 | 870 |
| Amount of water sprayed (kg/hr) | 180 | 190 | 185 |
| Amount of water sprayed/amount of compound treated | 0.9 | 1 | 1.03 |
| Ratio of excess air | 2.05 | 2.08 | 2.05 |
| Chlorine gas concentration (ppm) | 4.3 | 4.1 | 2.05 |
| Decrease ratio of sand (per day) | 1.4–1.5 wt %/day (56–60 kg) | | |
| Ash recovery ratio | 30 to 50 kg/hr | | |
| Amount of Na (*1) | 668 ppm | | |
| Amount of Na (*2) | 2990 ppm | | |

Note:
*1 Na contained in the inert medium.
*2 Na Contained in the ash recovered.

Absolutely no low-melting compound was obsered to adhere to the furnace wall and the ducts.

Comparative Example 1

The experiment of Example 1 was faithfully repeated by using the following conditions in place of those involved in Example 1.

| | I | II |
|---|---|---|
| Amount of compound treated (kg/hr) | 200 | 150 |
| Fluidized bed temperature (°C.) | 910 | 650 |
| Furnace top temperature (°C.) | 870 | 900 |
| Amount of water sprayed (kg/hr) | 120 | 204 |
| Amount of water sprayed/amount of compound treated | 0.6 | 1.6 |
| Ratio of excess air | 2.8 | 2.0 |
| Chlorine gas concentration (ppm) | 290.8 | Not stabilized |

In Example 1, the amount of water sprayed remained in the range of from 0.8 to 1.5 per unit amount of the compound treated and the chlorine gas concentration in the exhaust gas of combustion was stable, registering the values of 4.3, 4.1 and 2.05 ppm respectively at the 10th, 20th and 30th hours of operation. In Comparative Example 1, however, the amount of water sprayed was either excessively small or excessively large. When it was excessively small, the chlorine gas concentration in the exhaust gas of combustion increased beyond the tolerable limit. When it was excessively large, the furnace bottom temperature could not be stabilized and, consequently, the chlorine gas concentration was not stable. Thus, the operation could not be continued stably.

Comparative Example 2:

The experiment of Example 1 was faithfully repeated under entirely the same conditions as those indicated under Columns I and II, with the only exception that the inert medium whose particles were used for fluidization was composed of 84.02% of $SiO_2$, 8.75% of $Al_2O_3$, 1.67% of $Mg_2O$, 3.66% of $K_2O$ and the balance to make up 100% of other components. The results of the experiment are shown below.

| | I | II |
|---|---|---|
| Furnace bottom temperature (°C.) | 880 | 900 |
| Furnace top temperature (°C.) | 960 | 950 |
| Chlorine gas concentration (ppm) | 10 | 18 |

Deposition of clinker was observed on the furnace wall and ducts and in the fluidized bed and the fluidization of the particles was recognized to be obstructed. On analysis, the clinker was found to have the following compositions:

| | I | II |
|---|---|---|
| $SiO_2$ | 63.8 wt % | 68.5 wt % |
| $Al_2O_3$ | 16.5 | 13.9 |
| Na | 1.11 | 0.94 |
| K | 0.4 | 0.38 |
| Ca | 6.51 | 5.87 |

The increase in Na and K contents in the clinker indicates an increase in Na and K contents in the ash and, therefore, the data clearly indicate that the Na and K contents in the ash were increased. Comparative Example 2 shows that the composition of the particles of fluidized bed is an important factor for smooth progress of the fluidized-solids combustion of the organic chlorine compound and, more specifically, that the combustion does not proceed smoothly when the requirement that the combined concentration of $SiO_2$ and $Al_2O_3$ should be at least 95% by weight and the combined concentration of $Na_2O$ and $K_2O$ should not exceed 1.0% by weight is not satisfied.

EXAMPLE 2

A solid organic chlorine compound was subjected to combustion in the same furnace using sand of the same composition as in Example 1. The sand had particle diameters ranging from 0.3 to 0.7 mm. The solid organic chlorine compound used in this case was composed of 10% by weight of water and the balance to make up 100% by weight of components (including 50% of C, 10% of H and 40% of Cl determined on dry basis). The combustion conditions involved and the results obtained were as follows.

| | I | II | III |
|---|---|---|---|
| Amount of solid compound treated (kg/hr) | 190 | 200 | 200 |
| Fluidized bed temperature (°C.) | 950 | 960 | 900 |
| Furnace top temperature (°C.) | 850 | 830 | 880 |
| Amount of water sprayed (kg/hr) | 180 | 179 | 185 |
| Amount of water sprayed/amount of compound treated | 0.95 | 0.90 | 0.93 |
| Ratio of excess air | 1.92 | 1.80 | 1.76 |
| Chlorine gas concentration (ppm) | 0.13 | 0.49 | 0.23 |

As shown above, the chlorine gas concentration in the exhaust gas of combustion was invariably less than 1.0 ppm.

What is claimed is:

1. A method for the fluidized-solids incineration of an organic chlorine compound, which method comprises:

causing particles of an inert medium to be fluidized so as to form a fluidized bed, controlling the composition of said bed so that the particles of the inert medium for the fluidized bed contain $SiO_2$ and $Al_2O_3$ in a combined concentration of at least 95% by weight and $Na_2O$ and $K_2O$ in a combined concentration of not more than 1.0% by weight, causing the organic chlorine compound to be admixed into the fluidized bed in conjunction with water or an aqueous solution and simultaneously subjecting the compound to combustion, and consequently giving rise to an exhaust gas having an extremely low chlorine gas content.

2. The method according to claim 1, wherein the combustion of the organic chlorine compound produces a low-melting compound, which is allowed to adhere to parts of particles into which the particles of the inert medium are crushed by means of thermal shocks generated by incorporation of water or an aqueous solution in the fluidized bed and is discharged as entrained by the parts.

3. The method according to claim 1, wherein the combustion of the organic chlorine compound is carried out at temperature in the range of from 750° C. to 1050° C.

4. The method according to claim 1, wherein the amount of water or aqueous solution admixed into the fluidized bed is in the range of from 0.8 to 1.5 by weight based on a unit amount of the organic chlorine compound.

5. The method according to claim 1, which further comprises adding water to the exhaust gas of combustion and thereby controlling the temperature of combustion and, at the same time, converting chlorine gas into hydrochloric acid.

6. An incinerator for the fluidized-solids combustion of an organic chlorine compound which comprises:

a vertical, cylindrical hollow column, a perforated dispersion plate disposed in the lower part of the hollow column, an inlet disposed below the perforated dispersion plate and adapted to introduce upwardly a current of a gas for fluidization, particles of an inert medium mounted on the perforated dispersion plate for the formation of a fluidized bed, wherein said particles containing $SiO_2$ and $Al_2O_3$ in a combined concentratin of at least 95% by weight and $Na_2O$ and $K_2O$ in a combined concentration of not more than 1.0% by weight, at least one inlet radially disposed in the column wall at a level such that it opens into the hollow column interior at the position destined to come into direct contact with the fluidized bed to be formed of said particles of inert medium whereby the inlet serves to admit a liquid or slurry-like organic chlorine compound and water or an aqueous solution into the column interior, an inlet disposed in the column wall at a level such that it opens into the hollow column interior above the position destined to come into direct contact with the fluidized bed to be formed of said particles of inert medium whereby the inlet serves to admit a solid organic chlorine compound into the column interior, an outlet disposed in the upper portion of the hollow column and adapted to discharge the exhaust gas of combustion into the ambient air, and a burner adapted to elevate the temperature of the incinerator.

7. The incinerator according to claim 6, wherein said at least one inlet for admitting the liquid or slurry-like organic chlorine compound and water or the aqueous solution is a nozzle of a double-wall construction having an inner tube and a concentrically disposed outer tube, the space enclosed between the inner tube and the outer tube serving as a passage for air.

8. The incinerator according to claim 6, which further comprises an inlet disposed in the ceiling of the hollow column for admitting water.

9. The incinerator according to claim 8, wherein the inlet disposed in the ceiling of the hollow column for admitting water is a nozzle of a double-wall construction having an inner tube serving to pass water and a concentrically disposed outer tube, the space enclosed between the inner tube and the outer tube serving as a passage for air.

10. The incinerator according to claim 7, wherein said inlet is composed of at least one inlet for admitting the liquid or slurry-like organic chlorine compound and at least one inlet for admitting water or the aqueous solution which are separately disposed.

* * * * *